US005222783A

United States Patent [19]

Lai

[11] Patent Number: 5,222,783

[45] Date of Patent: Jun. 29, 1993

[54] CHAIR WITH ITS BACKREST ADJUSTABLE IN ITS ANGLE

[76] Inventor: Soon L. Lai, No. 3, Alley 5, Lane 174, PinDeeng St., ChiaYi City, Taiwan

[21] Appl. No.: 800,968

[22] Filed: Dec. 2, 1991

[51] Int. Cl.[5] ..... A47C 3/30

[52] U.S. Cl. ..... 297/306; 297/345; 297/363

[58] Field of Search ..... 297/291, 300, 306, 354, 297/316, 313, 326, 325, 344, 345, 363, 375

[56] References Cited

U.S. PATENT DOCUMENTS

| | | | |
|---|---|---|---|
| 635,452 | 10/1899 | Walton | 297/375 |
| 699,882 | 5/1902 | Lamplugh et al. | 297/363 X |
| 1,986,105 | 1/1935 | Foote | 297/306 X |
| 3,756,654 | 9/1973 | Bauer | 297/345 |
| 3,960,406 | 6/1976 | Buker | 297/345 |
| 4,257,582 | 3/1981 | Wirges | 297/345 X |
| 4,328,943 | 5/1982 | Eldon, III | 297/345 X |
| 4,603,905 | 8/1986 | Stucki | 297/306 X |
| 4,832,407 | 5/1989 | Serber | 297/306 X |

*Primary Examiner*—Kenneth J. Dorner
*Assistant Examiner*—Milton Nelson, Jr.
*Attorney, Agent, or Firm*—Jacobson, Price, Holman & Stern

[57] ABSTRACT

A chair with its backrest adjustable in its angle comprising a steering rod to keep the backrest upright or tilted in a certain pre-set angle and a control rod to push down a press button of an air pressure cylinder which functions to raise up or lower down the seat of the chair when the control rod is rotated.

4 Claims, 3 Drawing Sheets

CHAIR WITH ITS BACKREST ADJUSTABLE IN ITS ANGLE

BACKGROUND OF THE INVENTION

Conventional office chairs with casters have a backrest supported by ribs whose ends are connected with the bottom of a seat and supported by springs. The backrests have only a little elasticity and cannot be tilted to a substantial angle.

SUMMARY OF THE INVENTION

An object of this invention is to provide a chair with a backrest adjustable in angle, improving conventional office chairs.

The two principal improvements are as follows.

1. A steering rod is provided having an inner end able to be moved inwardly fit to insert in a shaft tube in a limit plate fixed with the backrest so as to keep the backrest immovable in upright position, and able to be pulled outwardly from the shaft tube so as to make the backrest tiltable to a certain pre-set angle defined by two projections in a plate base which engages the limit plate.

2. A control rod is provided in a U-shaped plate of a bottom supporter of the chair, having a protrusion near its inner end to push down a press button of an air pressure cylinder for controlling the height of the seat so as to actuate the air pressure cylinder when the control rod is rotated

BRIEF DESCRIPTION OF THE DRAWINGS

The invention will now be described in detail with reference to accompanying drawings wherein.

DETAILED DESCRIPTION OF THE INVENTION

Figure 1:
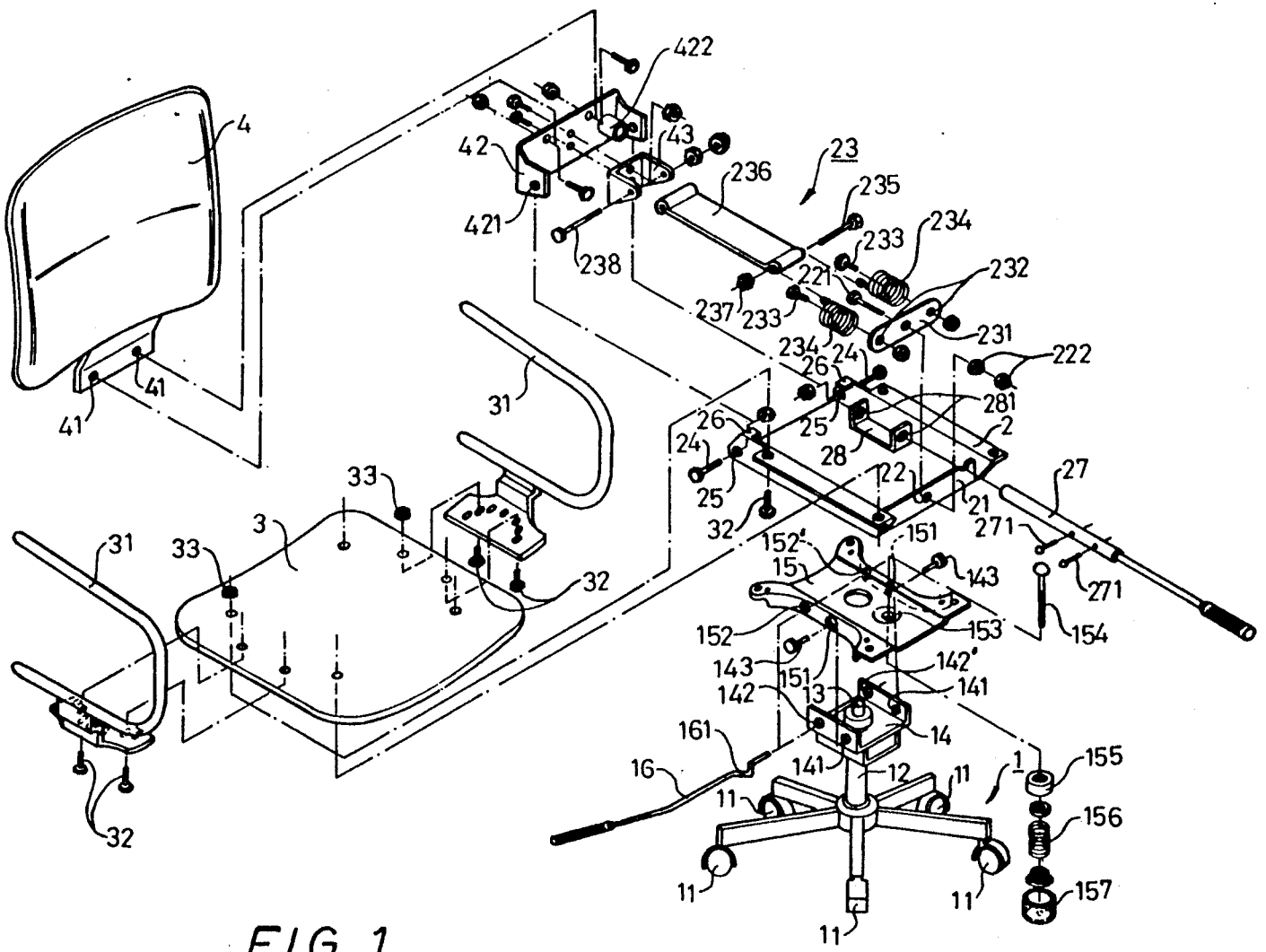
FIG. 1 is an exploded perspective view of a chair according to the present invention.
Figure 2:
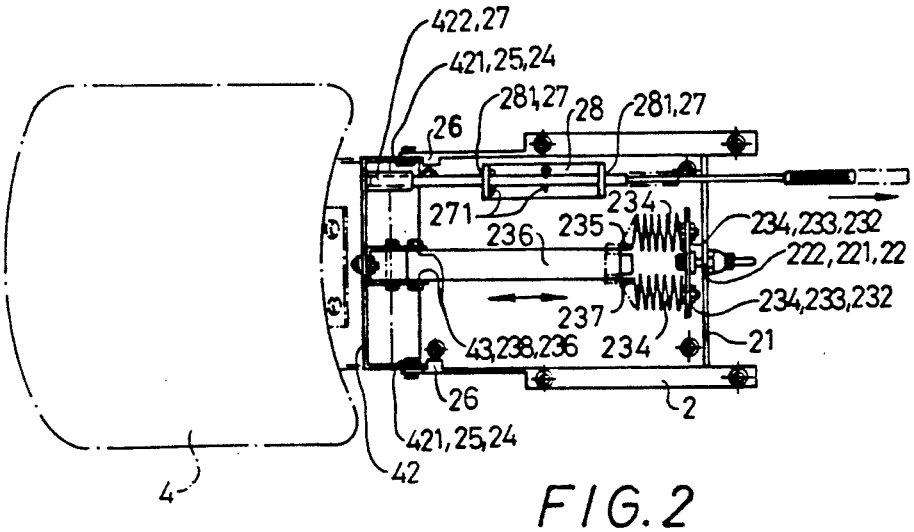
FIG. 2 is a cross-sectional view taken along line 2—2 of FIG. 3.
Figure 3:
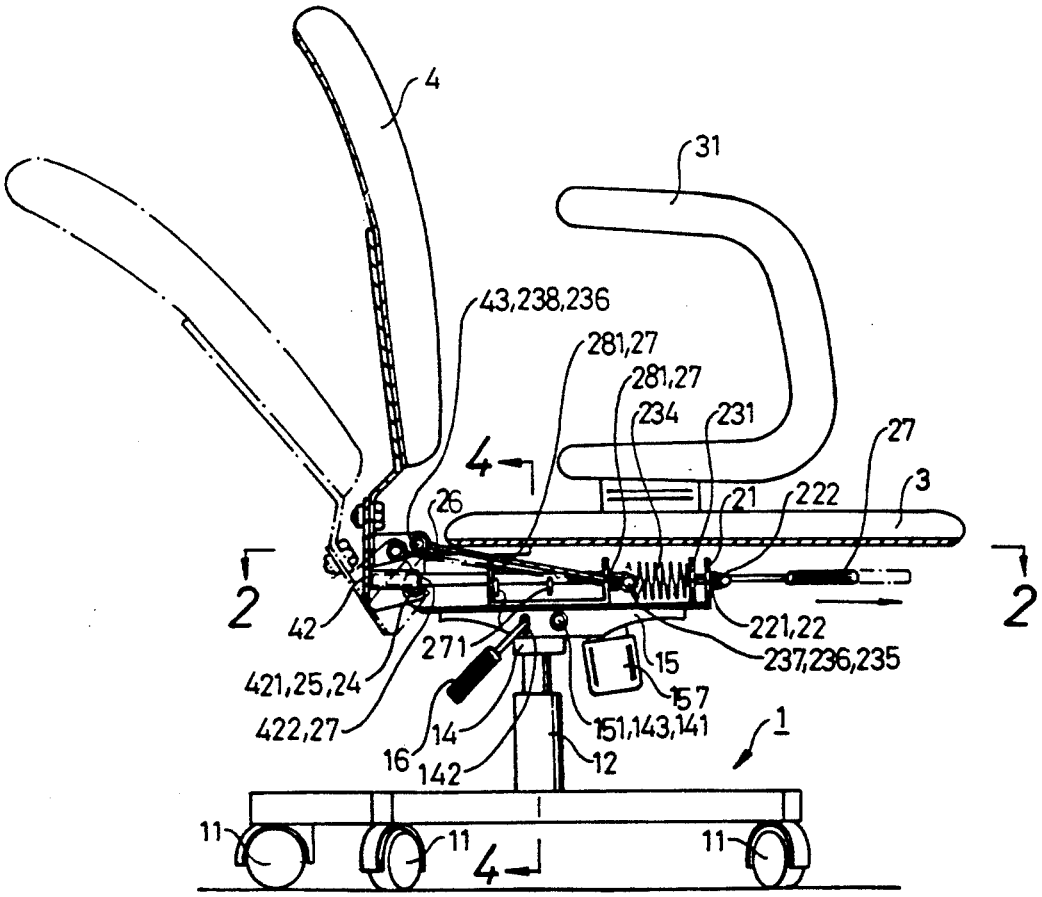
FIG. 3 is a side view of the chair rest adjustable in its angle in the present invention.

A chair with a backrest adjustable in angle as in the present invention, is shown in FIGS. 1, 2 & 3, and comprises a bottom supporter 1, a base plate 2, a seat 3, and a backrest 4 as the main components.

The bottom supporter 1 includes a plurality of casters 11 for the chair to move freely on the ground, an air pressure cylinder 12 vertically provided at the center, a press button 13 to actuate the cylinder 12 to adjust the height of the seat 3, a U-shaped plate 14 provided at the top having two opposite vertical sides respectively bored with two holes 141 for rotatable pins 143 to insert in for attaching an intermediate plate 15, which can pivot-somewhat with the pins 143 as a center, and two holes 142, 142' for a control rod 16 to pass through and be inserted in the holes 152, 152' in the intermediate plate 15 to hold the plate 15 immovable.

The intermediate plate 15 has a side hole 151 for a rotatable pin 143 to attach the plate 15 on the U-shaped plate 14, and the side holes 152, 152' for the control rod 16 to pass through. The plate 15 cannot pivot when the control rod 16 passes through both the holes 142, 142' and 152, 152', but the plate 15 can pivot somewhat when the control rod 16 is withdrawn from holes 142' and 152'. The control rod 16 can rotate while located in the holes 142, 142', 152, & 152', causing a protrusion 161 provided near its end to push down on the press button 13 to actuate the air pressure cylinder 12. The plate 15 also has a hole 153 for a bolt 154 to pass through vertically to combine with a ring 155, a coiled spring 156 and a cap 157 to provide the chair with a rocking function.

The plate 2 is positioned under the seat 3, combined together with the intermediate plate 15 as an unit, and having an upright wall 21 bored with a hole 22 for a bolt 221 to pass through and thread onto a nut 22 to attach an elongate plate 231 of an elastic assembly 23 with the wall 21. The plate 231 has two holes 232 for receiving two bolts 233 to thread with two nuts and mount coiled springs 234 having one of their ends resting on the plate 231 and the other of their ends formed into annular hooks for a bolt 235 to pass through to connect the springs with a connecting plate 236 which has an end tubular hole for the bolt 235 and pass through to screw with a nut 237. The connecting plate 236 has another tubular hole at the opposite end for a bolt 238 to pass through to connect the plate 236 with a U-shaped connector 43 of the backrest 4.

The elastic assembly 23 includes the connecting plate 236, the elongate plate 231, the two coiled springs 234, bolts 233, 235 and nuts combined to pull back automatically the backrest with the elasticity of the springs 234.

The seat 3 is combined with the plate 2 at its bottom, and two U-shaped armrests 31 are attached by means of bolts 32, and nuts 33 at both sides of the seat 3, as is well-known in the art. The seat 3 can be padded with foam rubber or the like to make it comfortable for sitting on.

The backrest 4 has two holes 41 at the bottom to connect a limit plate 42 with the backrest 4, and the limit plate 42 is connected with U-shaped connector 43 linked to one end of the connecting plate 236. Therefore, after the backrest 4 is pushed backward, it can be automatically pulled back to its original position by the elasticity of the two coiled springs 234. The limit plate 42 has two side holes 421 for two bolts 24 to pass through to combine the limit plate 42 with the plate 2 through bolts 24 to pass through holes 25, and the limit plate 42 is kept positioned inside both side walls of the plate base 2 and can be inclined through a limited angle with the bolts 24 as pivots, with two protrusions 26 provided in the plate base 2 forming stops. The limit plate 42 also has a tube 422 for the end of a steering rod 27 to fit in for keeping the limit plate 42 and the backrest 4 immovable.

The steering rod 27 passes through two holes 281 in a U-shaped bracket 28 fixed on the plate 2, and has two position pins 271 provided crosswise and spaced apart a certain distance so that one of the pins 271 can be arrested by one of the bent side walls of the U-shaped bracket 28 limiting the movement of the steering rod 27 to a certain distance.

Next, referring to FIGS. 2 & 3, when the steering rod 27 is moved insert into the shaft tube 422, the backrest 4 is kept upright and immovable as shown in FIG. 3. When the steering rod 27 is pulled out of the shaft tube 422 as shown in dotted lines in FIGS. 2 & 3, the backrest 4 can be inclined backward, and kept in its inclined position by the position protrusions 26 in the plate base 2 touching and stopping the limit plate 42.

Figure 4:
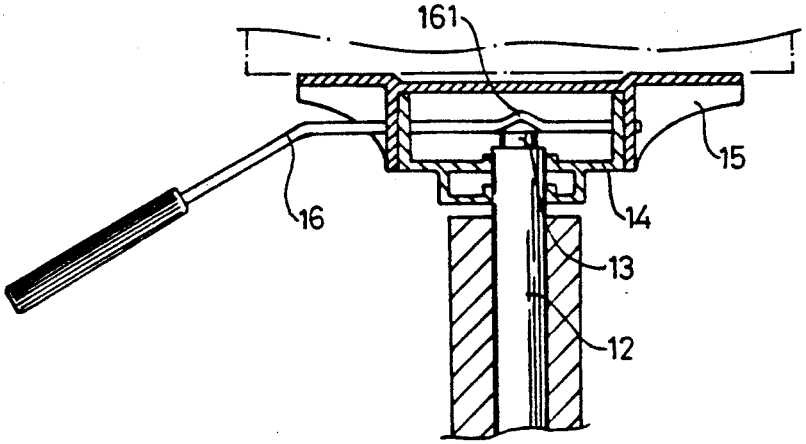
FIG. 4 is a cross-sectional view taken along line 4—4 of FIG. 3.
Figure 5:
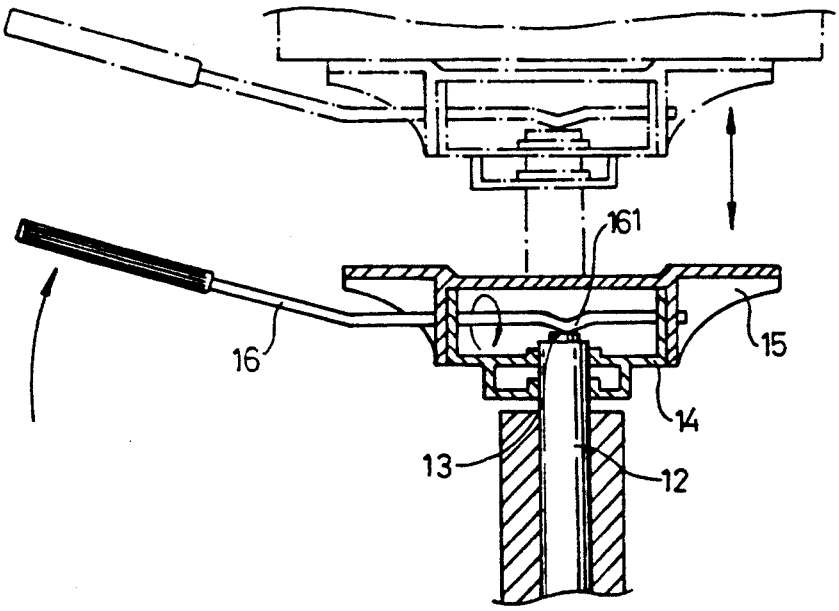
FIG. 5 is a view similar to FIG. 4 showing a control rod in an actuating position.

FIG. 4 shows that when the protrusion 161 on the control rod 16 is not pushing down the press button 13, the air pressure cylinder 12 cannot function to move up or down the seat 3. But when the control rod 16 is rotated, as shown in FIG. 5, to make the protrusion 161 face down and push down on the press button 13, the air pressure cylinder 12 can function to move up or down the seat 3.

In short, the backrest 4 can be adjusted to an upright or tilted position by means of the steering rod 27, and the seat 3 can be adjusted in height by means of the control rod 16.

What is claimed is:

1. A chair having a seat, a tiltable backrest secured to the seat, a bottom support and an air pressure cylinder connected between the bottom support and the seat for adjusting the height of the seat, the cylinder having a press button at an upper end thereof for controlling operation of the cylinder, the chair further including a U-shaped plate supported at an upper end of the cylinder and having upwardly extending side walls, the press button projecting from said plate between the side walls, an intermediate plate connected to said U-shaped plate, a base plate with upstanding side walls connected to the intermediate plate, the upstanding side walls of the base plate being connected to an undersurface of the seat, a U-shaped bracket on the base plate between the side walls and having upstanding front and back walls with aligned holes therein, a steering rod extending through said holes for front and back movements, a limit plate connected to the backrest and a tube element on the limit plate for receiving one end of the steering rod when the backrest is in an upright position and the rod is moved back in said holes to prevent the backrest from tilting and for releasing said one end of the rod when the rod is moved forward in said holes allowing the backrest to tilt backwards.

2. A chair as claimed in claim 1, wherein the limit plate is pivotally connected to the base plate and the base plate includes a pair of projections for engaging the limit plate and limiting backward tilting movement of the backrest.

3. A chair as claimed in claim 1, including resilient means resisting backward tilting of the backrest and comprising tension spring means connected at a front end to an elongate plate attached to the base plate, and a connecting plate having a pivotal connection at a front end thereof to a backend of the spring means, and a further pivotal connection at a backend thereof to a bracket on the limit plate.

4. A chair as claimed in claim 1, including a control rod for the press button extending through apertures in the side walls of said U-shaped plate, the control rod having a central protrusion for selectively depressing and releasing the press-button by rotation of the control rod so as to operate the air pressure cylinder.

* * * * *